US006200462B1

(12) United States Patent
Cash et al.

(10) Patent No.: US 6,200,462 B1
(45) Date of Patent: Mar. 13, 2001

(54) PROCESS FOR REVERSE GAS FLOW IN HYDROPROCESSING REACTOR SYSTEMS

(75) Inventors: Dennis R. Cash, Novato; Hyung-Jae A. Yoon, Richmond, both of CA (US)

(73) Assignee: Chevron U.S.A. Inc., San Francisco, CA (US)

( * ) Notice: Subject to any disclaimer, the term of this patent is extended or adjusted under 35 U.S.C. 154(b) by 0 days.

(21) Appl. No.: 09/227,615

(22) Filed: Jan. 8, 1999

Related U.S. Application Data

(60) Provisional application No. 60/083,359, filed on Apr. 28, 1998.

(51) Int. Cl.[7] ..... C10G 45/00
(52) U.S. Cl. ..... 208/89; 208/57; 208/59
(58) Field of Search ..... 208/89

(56) References Cited

U.S. PATENT DOCUMENTS

| | | | |
|---|---|---|---|
| 3,172,836 | 3/1965 | Robbers | 208/59 |
| 3,203,889 | 8/1965 | Pollitzer et al. | 208/57 |
| 3,256,178 | 6/1966 | Hass et al. | 208/89 |
| 3,328,290 | 6/1967 | Hengstebeck | 208/89 |
| 3,364,134 | 1/1968 | Hamblin | 208/93 |
| 3,475,322 | 10/1969 | Carson | 208/89 |
| 3,489,674 | 1/1970 | Borst, Jr. | 208/108 |
| 3,494,855 | 2/1970 | Stine et al. | 208/97 |
| 3,546,094 | 12/1970 | Jaffe | 208/59 |
| 3,728,249 | 4/1973 | Antezana et al. | 208/57 |
| 3,779,897 * | 12/1973 | Wrench et al. | 208/89 |
| 3,847,799 | 11/1974 | Munro | 208/89 |
| 4,011,154 | 3/1977 | Stangeland et al. | 208/59 |
| 4,082,647 | 4/1978 | Hutchings et al. | 208/78 |
| 4,197,184 | 4/1980 | Munro et al. | 208/89 |
| 4,283,272 | 8/1981 | Garwood et al. | 208/59 |
| 4,615,789 | 10/1986 | Bridge et al. | 208/143 |
| 4,720,337 | 1/1988 | Graziani et al. | 208/58 |
| 5,009,768 | 4/1991 | Galiasso et al. | 208/89 |
| 5,114,562 | 5/1992 | Haun et al. | 208/89 |
| 5,290,427 | 3/1994 | Fletcher et al. | 208/89 |
| 5,382,349 | 1/1995 | Yoshita et al. | 208/49 |
| 5,403,469 | 4/1995 | Vank et al. | 208/78 |
| 5,522,983 | 6/1996 | Cash et al. | 208/59 |
| 5,603,824 | 2/1997 | Kyan et al. | 208/208 R |

FOREIGN PATENT DOCUMENTS

| | | |
|---|---|---|
| 787787A2 | 1/1997 | (EP) . |
| 1270607 | 8/1970 | (GB) . |
| WO97/38066 | 10/1997 | (WO) . |

* cited by examiner

*Primary Examiner*—Helane Myers
(74) *Attorney, Agent, or Firm*—Penny L. Prater; Alan W. Klaassen; David M. Tuck

(57) ABSTRACT

A process for reverse gas flow to obtain high conversion, selective hydrotreating and product selectivity in hydroprocessing reactor systems is disclosed. In the integrated process, hydrogen recovered from a hydrotreating reactor is purified and used as a source of hydrogen for a hydrocracking reaction zone. Hydrogen recovered from the hydrocracking reaction zone is recovered without substantial cooling and used as a source of hydrogen for the hydrotreating reaction zone.

16 Claims, 1 Drawing Sheet

PROCESS FOR REVERSE GAS FLOW IN HYDROPROCESSING REACTOR SYSTEMS

Figure 1:
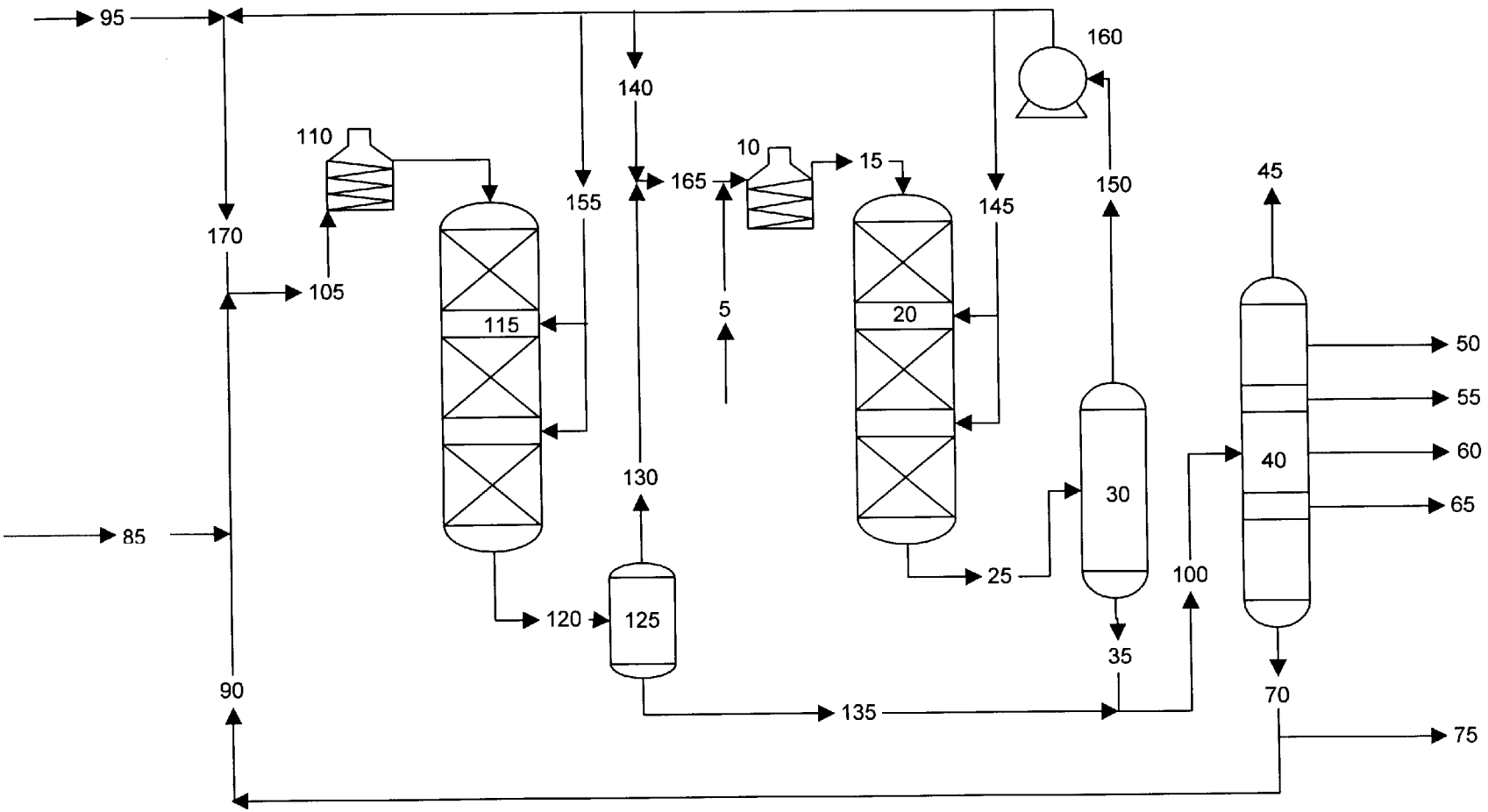

This application claims priority from U.S. Provisional Application Ser. No. 60/083,359, filed Apr. 28, 1998, the entire disclosure of which is incorporated herein by reference for all purposes.

FIELD OF THE INVENTION

The present invention relates to the field of hydroprocessing. In particular, the present invention relates to hydroprocessing to obtain high conversions, product selectivity and selective hydrotreating of specific boiling range products.

BACKGROUND OF THE INVENTION

Much of refinery processing involves reaction of refinery streams in a hydrogen atmosphere. In order to maximize conversion efficiencies and to maintain catalyst life, excess hydrogen is generally used in the catalytic conversion processes, with the unreacted hydrogen being recovered, purified and repressurized for use as a recycle stream. Such recycle processes are costly, both in energy and in equipment. Some progress has been made in developing methods for using a single hydrogen loop in a two-stage reaction process.

U.S. Pat. No. 5,114,562 teaches a multi-reactor zone process for the production of low aromatics, low sulfur jet fuel or diesel fuel. The two reaction zones, one for desulfurization and one for hydrogenation, operate in a series flow arrangement with a common hydrogen supply system. This process uses strippers to remove $H_2S$ from cooled hydrogen rich gases recovered from effluent streams, to permit use of the stripped hydrogen stream in both the desulfurization reaction zone and the hydrogenation reaction zone.

U.S. Pat. No. 5,403,469 teaches a parallel hydrotreating and hydrocracking process. Effluent from the two processes are combined in the same separation vessel and separated into a vapor comprising hydrogen and a hydrocarbon-containing liquid. The hydrogen is shown to be supplied as part of the feedstreams to both the hydrocracker and the hydrotreater.

U.S. Pat. No. 3,172,836 teaches a general process for processing a hydrocarbon feed in a catalyst bed, passing a liquid fraction from a first catalyst bed, together with hydrogen, through a second catalyst bed, separating the effluent from the second catalyst bed into a liquid portion and a vapor portion. The vapor portion is combined with the hydrocarbon feed in the first catalyst bed.

U.S. Pat. No. 4,197,184 discloses a conventional multiple-stage process for hydrorefining and hydrocracking a heavy hydrocarbonaceous charge stock. In the process, hydrocracked effluent is admixed with hydrorefined effluent and the combination separated into a hydrogen rich vaporous stream and normally liquid material. The cooled vapor stream is then used as a source of hydrogen and as a quench fluid for both the hydrorefining reaction zone and the hydrocracking reaction zone.

EP 787,787 discloses a hydroprocess in parallel reactors, with hydrogen flowing in series between the reactors. Effluent from a first reaction zone is separated into a first hydrogen rich gaseous stream and a first hydroprocessed product stream. The first hydrogen rich gaseous stream is shown as being used as quench for a second reaction zone. The first hydrogen rich gaseous stream is also combined with a second hydrocarbon feedstock and fed to the second reaction zone, at a lower hydrogen partial pressure than is the first reaction zone. Effluent from the second reaction zone is separated, the second hydrogen rich gaseous stream being recycled to the first reaction zone, both as a quench stream and as a reactant in combination with a first hydrocarbon feedstock.

SUMMARY OF THE INVENTION

An objective therefore of the present invention is to reduce the number of processing units in an integrated hydroconversion process. Another objective of the present invention is to reduce the heating and repressurization requirements of an integrated hydroconversion process. Another objective of the present invention is to supply the hydrogen requirements of an integrated hydroconversion process with reduced hydrogen distribution complexity and processing duplication. The present invention serves to accomplish these objectives in a single reaction loop at lower cost than with multiple loops, while maintaining the advantages of a multiple loop system, including higher reaction rates or with catalysts tailored for pretreated feeds.

The present invention includes a process for reverse gas flow to obtain high conversion, selective hydrotreating and product selectivity in a hydroprocessing reactor system. Accordingly, the present invention provides a method of processing a hydrocarbon feed comprising:

passing a hydrocarbon feed to a hydrotreating zone, contacting at hydrotreating conditions the hydrocarbon feed with a hydrogen feed stream in the presence of a hydrotreating catalyst, and recovering a hydrotreating zone effluent therefrom;

separating the hydrotreating zone effluent and recovering at least a liquid fraction and a hydrogen rich gaseous stream;

passing the liquid fraction and a portion of the hydrogen rich gaseous stream to a hydrocracking zone, contacting the liquid fraction and the portion of the hydrogen rich gaseous stream at hydrocracking conditions with a hydrocracking catalyst and recovering therefrom a hydrocracking zone effluent;

passing the hydrocracking zone effluent to a vapor recovery zone and recovering from the vapor recovery zone at least a vapor stream; and passing the vapor stream without substantial cooling to the hydrotreating zone for combining with the hydrogen feed stream.

The process of the invention is directed generally to an integrated hydroconversion process having at least two reaction zones in separate reactor vessels. Raw feed is introduced to a first reactor with hydrogen at conditions preselected for hydrotreating the feed. At least one liquid product from the first reactor is reacted in the presence of hydrogen in a second reaction zone at conditions preselected for hydrocracking the feed. Unreacted hydrogen recovered from the second reaction zone is relatively free of contaminants such as hydrogen sulfide and ammonia. In the practice of the present invention, the unreacted hydrogen from the second reaction zone is recovered at substantially the pressure and the temperature of the second reaction zone, and passed directly, without substantial cooling, as a portion of the hydrogen feed to the first reaction zone. Unreacted hydrogen recovered from the first reaction zone is purified to remove contaminants such as hydrogen sulfide and ammonia. During purification, the unreacted hydrogen from the first reaction zone is cooled. A portion of the cooled hydrogen stream is used as quench, to cool the reactants within the first reaction zone and the second reaction zone.

Among other factors, the present invention is based on the discovery that using the hydrogen from the second reaction zone, without substantial cooling and at the pressure of the second reaction zone, as hydrogen feed to the first reaction zone, produces substantial savings in both heating and in repressurization. The present invention provides reaction zones in series configuration with respect to hydrogen flow, such that the unused hydrogen from a second reaction zone employed for converting a relatively clean feed is used as a source of hydrogen for the initial processing in a first reaction zone. Such a single reaction loop lowers costs as compared to the use of conventional multiple reaction loops while maintaining the advantages of higher reaction rates, using catalysts tailored for converting pretreated feeds within a multiple reaction loop system. The series configuration reduces gas circulation, which reduces both investment and operating costs. The capital cost is lower due to smaller equipment and piping. Operating costs are lower due to less compressor power to recirculate gas. The series configuration provides that (a) the top bed catalysts are not contaminated with feed impurities, (b) the reaction rate in the top beds is not inhibited by substantial quantities of hydrotreating byproducts, e.g., $NH_3$ and $H_2S$, and (c) hydrogen partial pressures are maximized for the high conversion processes. The present invention is thus based on the discovery of an integrated hydroconversion process which may be operated at much lower cost, both in terms of operating cost and of construction and equipment cost, than conventional integrated processes.

IN THE FIGURES

FIG. 1 illustrates a preferred embodiment of the integrated process of the present invention.

DETAILED DESCRIPTION OF THE INVENTION

The invention is a method of hydrotreating a hydrocarbon feed to obtain high conversion, selective hydrotreating and product selectivity in a hydroprocessing reactor system. Feedstocks suitable for use in the invention and desired products obtained include any conventional or known hydrocracking/hydroprocessing feedstocks and products. The feedstocks and desired products for the instant process include those disclosed in U.S. Pat. Nos. 5,277,793; 5,232,577; 5,073,530; 4,430,203; and 4,404,088 which are incorporated herein by reference.

The hydrocarbon feed may be any refinery stream containing materials which boil above about 450° F. (232° C.), preferably above about 500° F. (260° C.) and contain sulfur and nitrogen. Generally, the hydrocarbon feed contains at least 100 ppm of sulfur and/or at least 100 ppm of nitrogen; feeds containing 1% or more of either sulfur or nitrogen may be suitably treated in the present process. In one preferable embodiment, a hydrocarbon feed is selected from a residuum, a vacuum gas oil, a middle-distillate stream, and mixtures thereof.

Reference is now made to a preferred embodiment illustrated in FIG. 1. In the present invention, a hydrocarbon feed 5 is combined with hydrotreater hydrogen feed 165, heated in hydrotreater feed furnace 10, and the combined hydrotreater feedstock 15 is passed to a hydrotreating zone 20. The hydrotreating zone 20 contains one or more catalyst layers which are known to have hydrotreating activity. Typical hydrotreating functions include removing heteroatoms such as sulfur and nitrogen, removing metals contained in the feed, and saturating at least some of the olefins and aromatics in the feed. Generally, at least about 75% of the nitrogen compounds and at least about 75% of the sulfur containing compounds are removed during hydrotreating. It is particularly desirable to remove multi-ring aromatic materials during hydrotreating, as they are particularly prone to fouling a hydrocracking catalyst which they might contact. A measure of cracking conversion may also occur, depending on the severity of the hydrotreating conditions. As used herein, conversion is related to a reference temperature, such as, for example, the minimum boiling point temperature of the feedstock. The extent of conversion relates to the percentage of feed boiling above the reference temperature which is converted during processing into products boiling below the reference temperature. In the process, the hydrocarbon feed 5 is contacted at hydrotreating conditions with a hydrotreating catalyst, e.g., a denitrification and desulfurization catalyst, to produce a hydrotreating zone effluent 25, which is recovered therefrom.

When the above-described process is used to hydrotreat feedstocks to remove sulfur and nitrogen impurities, the following hydrotreating conditions will typically be used: reaction temperature, 400° F.–900° F. (204° C.–482° C.), preferably 650° F.–850° F. (343° C.–454° C.); pressure, 500 to 5000 psig (pounds per square inch gauge) (3.5–34.6 MPa), preferably 1000 to 3000 psig (7.0–20.8 MPa); LHSV 0.5 $hr^{-1}$ to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically such hydrotreating catalysts are presulfided.

The hydrotreating zone effluent 25 contains unreacted hydrogen, a hydrocarbonaceous component and impurity gases generated during reaction, including hydrogen sulfide and ammonia. The hydrotreating zone effluent 25 is passed to purification zone 30, for separating a liquid product from a normally gaseous product in a series of separation units operated at varying pressures and temperatures in order to maximize the efficiency of the separation and produce a high purity hydrogen stream. Ammonia and $H_2S$ produced during hydrotreating are removed, typically by water scrubbing, and optionally by scrubbing using a sorbent such as an amine adsorbent. The effluent may also be cooled by any conventional means, e.g., by heat exchanger. At least a hydrogen rich gaseous stream 150 and a hydrotreated liquid stream 35 are recovered from the purification zone 30. The hydrogen rich gaseous stream 150 leaving the purification zone is therefore relatively free of both hydrogen sulfide and ammonia. A preferred hydrogen rich gaseous stream 150 is cooled and recovered at a temperature in the range of about 100° F. to about 300° F. (38° C.–149° C.) or in the range of about 100° F. to about 200° F. (38° C.–93° C). The now purified hydrogen rich gaseous stream 150 is repressurized through compressor 160, and distributed to various locations in the process. A portion of hydrogen rich gaseous stream 150 is introduced to hydrotreating zone 20 as a hydrotreater quench stream 145, added to the hydrotreating reaction zone to absorb some of the excess heat from the zone generated by the exothermic hydrotreating reactions occurring therein. An additional portion of hydrogen rich gaseous stream 150 is introduced to hydrocracking zone 115 as a hydrocracker quench stream 155. An additional portion of hydrogen rich gaseous stream 150 is combined with make-up hydrogen 95 for use in the hydrocracking reaction zone 115.

Hydrotreated liquid stream 35 is passed to separation zone 40, which is typically a distillation section comprising at least one distillation column, which may be run at either atmospheric conditions or under vacuum. A light product and at least one liquid product are recovered. As shown in FIG. 1, at least a fraction of liquid bottoms 70 is recovered for further processing as liquid fraction 90. Also shown in FIG. 1 is optional product stream 75, which is a bottoms product stream withdrawn from the integrated process for processing elsewhere, e.g. an FCC unit or a dewaxing unit for making a lubricating oil base stock.

In one embodiment, all of the unreacted and partially reacted products from separation zone 40 are recycled via stream 90 to the hydrocracking zone. Separation zone 40, in the preferred embodiment, is operated to produce a number of distillate streams. Five streams are shown in FIG. 1. These include light product 45, light naphtha stream 50, heavy naphtha stream 55, kerosene stream 60 and diesel stream 65. A liquid bottoms product 70, which contains unreacted hydrocarbons from the reaction zones and hydrocarbons which boil above a target temperature, (e.g. greater than about 500° F./260° C.) is also withdrawn.

In FIG. 1, liquid fraction 90 is combined with hydrocracker hydrogen feed 170 to form combined hydrocracker feedstock 105. Stream 170 is a hydrogen-containing stream derived from hydrogen rich gaseous stream 150. In the preferred embodiment, stream 170, which contains little or no ammonia or hydrogen sulfide, is combined with make-up hydrogen stream 95 and further combined with recycled liquid fraction 90 to form combined hydrocracker feedstock 105. The make-up hydrogen is substantially pure hydrogen, containing generally greater than about 75% hydrogen, with only minor quantities of contaminants such as hydrogen sulfide or ammonia. Such hydrogen feeds are well known in the art. Additional feeds 85, which may optionally be added to hydrocracking zone feedstock 105, include untreated, hydrotreated, or hydrocracked middle distillate feedstocks, catalytic cracker products, or vacuum gas oils from other refinery processes. Preferred feed streams for the first reaction zone contain less than about 200 ppm nitrogen and less than 0.25 wt % sulfur, though feeds with higher levels of nitrogen and sulfur, including those containing up to 0.5 wt % and higher nitrogen and up to 2 wt % sulfur and higher may be treated in the present process.

Combined feedstock 105 is heated in hydrocracking feed furnace 110, and the heated mixture passed to hydrocracking zone 115, where it is contacted at hydrocracking conditions with a hydrocracking catalyst. Suitable hydrocracking and hydroprocessing catalysts and reaction conditions include any conventional or known catalysts and reaction conditions. Typical hydrocracking conditions include: reaction temperature, 400° F.–950° F. (204° C.–510° C.), preferably 650° F.–850° F. (343° C.–454° C.); reaction pressure 500 to 5000 psig (3.5–34.5 MPa), preferably 1500–3500 psig (10.4–24.2 MPa); LHSV, 0.1 to 15 $hr^{-1}$ (v/v), preferably 0.25–2.5 $hr^{-1}$; and hydrogen consumption 500 to 2500 scf per barrel of liquid hydrocarbon feed (89.1–445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Hydrocracking zone effluent 120 recovered from the hydrocracking zone 115 is passed to vapor recovery zone 125, from which is recovered vapor stream 130 and a hydrocracked liquid stream 135. Vapor recovery zone 125 includes one or more vessels, generally flash separation vessels, for separating gaseous from liquid components in the hydrocracking zone effluent. An example separation scheme for a hydroconversion process is taught in U.S. Pat. No. 5,082,551, the entire disclosure of which is incorporated herein by reference for all purposes. In the preferred embodiment, the vapor recovery zone 125 is in fluid communication with the hydrotreating zone 20 and with the hydrocracking zone 115. Vapor stream 130 is a hydrogen rich stream which is useful as a source of hydrogen for the hydrotreating zone. Following separation, vapor stream 130 is passed to hydrotreating zone 20 at substantially the pressure of the hydrocracking reaction zone and without substantial cooling. It will be recognized that some incidental heat loss occurs in the processing vessels and piping used in passing the vapor stream 130 from the vapor recovery zone 125 to the hydrotreating zone 20. However, it is desirable to maintain such heat losses at a minimum, in order to save heating costs when adding the vapor stream 130 to the hydrotreating zone. A preferred vapor stream 130 is maintained at a temperature of at least about 350° F. (177° C.), more preferably at least about 500° F. (260° C.) and most preferably at least about 650° F. (371° C.). The vapor stream 130 is maintained at that temperature within vapor recovery zone 125 and at least up to the point at which it is combined with other streams for passing to the hydrotreating zone 20. Vapor recovery zone 125 is likewise maintained at a high temperature to minimize heat losses in this vessel. In practice a target first separation temperature is the design temperature for the separation unit, based on the design and metallurgical limit of the materials of construction of the unit. Accordingly, the preferred first separation zone is maintained at a temperature of at least about 350° F. (177° C.), more preferably at least about 500° F. (260° C.) and most preferably at least about 650° F. (371° C.), up to the temperature of the first reaction zone 115. In any event, vapor stream 130 is combined with hydrogen feed stream 140 to form hydrotreater hydrogen feed stream 165 for mixing with hydrocarbon feed 5 for passage to hydrotreating zone 20.

In the preferred embodiment illustrated in FIG. 1, hydrotreated liquid stream 35 and hydrocracked liquid stream 135 are combined to form combined liquid product 100. Combined stream 100 is fractionated in separation zone 40 to recover the desired products and to recycle unreacted, and partially reacted, hydrocarbons back to the hydrocracking zone 115.

The use of the two reaction zones can be varied in this invention. That is, the hydrotreating or hydrocracking reaction zones may each be a hydrotreating zone or may each be a hydrocracking zone. In one embodiment of the invention, the zone that first contacts the fresh feed is a hydrotreating zone, while the subsequent reaction zone is a hydrocracking zone. In another embodiment, the reverse is true.

Alternatively, each zone may both be either a hydrotreating zone or each a hydrocracking zone. Each may also be a combination or mixture of a hydrotreating zone and a hydrocracking zone.

Accordingly, the present invention provides a method of hydrotreating a hydrocarbon feed to obtain high conversion, selective hydrotreating and product selectivity in a hydroprocessing reactor system, said method comprising: passing a hydrocarbon feed selected from a residuum, a vacuum gas oil, middle distillate, and mixtures thereof to a hydrotreating zone; contacting said hydrocarbon feed at a temperature of about 400° F. to about 900° F. (204° C.–482° C.); a pressure of about 500 psig to about 5000 psig (3.5–34.6 MPa); a flow rate of about 0.5 $hr^{31\ 1}$ (v/v) LHSV to about 20 $hr^{-1}$ LHSV; and an overall hydrogen consumption of about 300 to about 2000 scf per barrel of liquid hydrocarbon feed (53.4–356 $m^3$ $H_2/m^3$ feed), with a hydrotreating catalyst; and recovering a hydrotreating zone effluent therefrom; passing said hydrotreating zone effluent to a purification zone for removal of $NH_3$ and $H_2S$, and recovering from said purification zone a hydrogen rich gaseous stream and a liquid hydrocarbon stream; passing said liquid hydrocarbon stream to a separation zone and recovering a light product, a liquid bottoms, and at least one side-cut product therefrom; passing said liquid bottoms and/or one or more side-cut products and a portion of said hydrogen rich gaseous stream to a hydrocracking zone; contacting said liquid bottoms and/or one or more side-cut products at a temperature of about 400° F. to about 950° F. (204° C.–510° C.); a pressure of about 500 psig to about 5000 psig (3.5–34,6 MPa); a flow rate of about 0.1 $hr^{-1}$ (v/v) LHSV to about 15 $hr^{-1}$ LHSV; and an overall hydrogen consumption of about 500 to about 2500 scf per barrel of liquid hydrocarbon feed (89.1–445 $m^3$ $H_2/m^3$ feed), with a hydrocracking catalyst; and recovering a hydrocracking zone effluent therefrom; passing said hydrocracking zone effluent to a vapor recovery zone, said vapor recovery zone being in fluid communication with the hydrotreating and hydrocracking zones and having a temperature above about 400° F (204° C.), and recovering therefrom a second liquid hydrocarbon stream and a vapor stream; passing said second hydrocarbon stream to said separation zone; and, passing said vapor stream to said hydrotreating zone.

An example process of this invention is as follows. A straight run vacuum gas oil which has a boiling point range of 500° F. to 950° F. (260° C.–482° C.) is contacted with hydrogen over a hydrotreating catalyst in a hydrotreating zone. The hydrotreating catalyst comprises nickel and molybdenum on an alumina binder. The hydrotreating zone is maintained at 720° F. (382° C.) and 2200 psig (15.3 MPa) total pressure at a feed rate of 1 $hr^{-1}$ (v/v) LHSV. Effluent from the hydrotreating zone is separated, using a number of separation units, into a liquid stream and a hydrogen rich gaseous stream, from which ammonia and hydrogen sulfide has been removed.

The liquid stream from the hydrotreating zone is fractionated, and a bottoms fraction, boiling between about 500° F. and 950° F. (260° C.–510° C.), is passed to a hydrocracking zone. The hydrogen feed to the hydrocracking zone is a fraction of the purified hydrogen rich gaseous stream from the hydrotreating zone, which has been pressurized to 2200 psig (15.3 MPa). The liquid and gaseous feeds are contacted in the hydrocracking zone over a catalyst comprising 20% ultrastable Y zeolite, nickel and tungsten on a silica alumina binder at 2200 psig (15.3 MPa) total pressure, 760° F. (404° C.) and a feed rate of 0.75 $hr^{-1}$ (v/v) LHSV. Effluent from the hydrocracking zone is separated in a high pressure separator maintained at 700° F. (371° C.) and 2000 psig (13.9 MPa). Hydrogen gas recovered from the high pressure separator at 550° F. (288° C.) is passed directly to the feed to the hydrotreating zone.

A comparative process duplicates the conditions of the present invention but with separate hydrogen recycle processes for the hydrocracker and for the hydrotreater. In the comparative process, effluent from the hydrotreating zone is separated to produce a purified, low pressure hydrogen stream at 150° F. (66° C.) and 300 psig (2.2 MPa), which is reheated and passed as recycle hydrogen to the hydrotreating zone. Likewise, effluent from the hydrocracking zone is separated to produce a purified, low pressure hydrogen stream at 150° F. (66° C.) and 300 psig (2.2 MPa), which is reheated and passed as recycle hydrogen to the hydrocracking zone.

When the two processes are compared, it is found that the total thermal energy required to operate the process of this invention is 40% less than for the comparative process, and the energy required for compression of the hydrogen streams in the present process is 25% less than for the comparative process.

What is claimed is:

1. An integrated hydroconversion process having at least two reaction zones in series with respect to hydrogen flow comprising:

a) passing a hydrocarbon feed selected from the group consisting of a residuum, a vacuum gas oil, middle distillate and mixtures to a hydrotreating zone, contacting at hydrotreating conditions, which comprise a temperature range from about 400° F. to about 900° F., a pressure range from about 500 psig to about 5000 psig, a flow rate range of about 0.5 hr to about 20 $hr^{-1}$ LHSV, and an overall hydrogen consumption range of from about 300 to about 5000 scf per barrel of liquid hydrocarbon feed, the hydrocarbon feed with a hydrogen feed stream in the presence of a hydrotreating catalyst, and recovering a hydrotreating zone effluent therefrom;

b) separating the hydrotreating zone effluent and recovering at least a liquid fraction and a hydrogen rich gaseous stream;

c) passing the liquid fraction and a portion of the hydrogen rich gaseous stream to a hydrocracking zone, contacting the liquid fraction and the portion of the hydrogen rich gaseous stream at hydrocracking conditions, which comprise a temperature range from about 400° F. to about 950° F., a pressure range from about 500 psig to about 5000 psig, a flow rate range of about 0.1 hr to about 15 $hr^{-1}$ LHSV, and an overall hydrogen consumption range of from about 500 to about 2500 scf per barrel of liquid hydrocarbon feed, with a hydrocracking catalyst and recovering therefrom a hydrocracking zone effluent;

d) passing the hydrocracking zone effluent to a vapor recovery zone and recovering from the vapor recovery zone at least a vapor stream; and e) passing the vapor stream without substantial cooling to the hydrotreating zone for combining with the hydrogen feed stream.

2. The method according to claim 1 wherein the vapor stream from the vapor recovery zone is passed to the hydrotreating zone for combining with the hydrogen feed stream at a temperature of at least about 350° F. (177° C.).

3. The method according to claim 1 wherein the step b) of separating comprises passing the hydrotreating zone effluent to a purification zone; recovering a hydrotreated liquid stream and the hydrogen rich gaseous stream; passing the hydrotreated liquid stream to a separation zone; and recovering therefrom at least the liquid fraction.

4. The method according to claim 1 wherein the hydrogen rich gaseous stream is recovered at a temperature between about 100° F. and about 300° F. (38° C.–149° C.).

5. The method according to claim 1 wherein at least a portion of the hydrogen rich gaseous stream is introduced to the hydrotreating zone as a quench stream.

6. The method according to claim 1 wherein at least a portion of the hydrogen rich gaseous stream is introduced to the hydrocracking zone as a quench stream.

7. The method according to claim 1 further comprising recovering a hydrocracked liquid stream from the vapor recovery zone.

8. The method according to claim 7 further comprising combining the hydrocracked liquid stream and the hydrotreated liquid stream to form a combined liquid product; passing the combined liquid stream to the separation zone; recovering from the separation zone a light product, and at least one liquid fraction; and recycling the at least one liquid fraction to the hydrocracking zone.

9. The method according to claim 8 wherein the liquid fraction recycled to the hydrocracking zone is selected from the group consisting of a liquid bottoms product stream, at least one side-cut from the separation zone and mixtures thereof.

10. An integrated hydroconversion process having at least two reaction zones in series with respect to hydrogen flow, comprising:

a) passing a hydrocarbon feed selected from the group consisting of a residuum, a vacuum gas oil, middle distillate and mixtures to a hydrotreating zone, contacting at hydrotreating conditions, which comprise a temperature range from about 400° F. to about 900° F., a pressure range from about 500 psig to about 5000 psig, a flow rate range of about 0.5 hr to about 20 $hr^{-1}$ LHSV, and an overall hydrogen consumption range of from about 300 to about 5000 scf per barrel of liquid hydrocarbon feed, the hydrocarbon feed with a hydrotreater hydrogen feed in the presence of a hydrotreating catalyst, and recovering a hydrotreating zone effluent therefrom;

b) passing the hydrotreating zone effluent to a purification zone and recovering therefrom a hydrogen rich gaseous stream and a hydrotreated liquid stream;

c) passing the hydrotreated liquid stream to a separation zone and recovering therefrom a light product, a liquid bottoms product, and at least one side cut;

d) passing at least a portion of the liquid bottoms product, at least a portion of the hydrogen rich gaseous stream, and make-up hydrogen to a hydrocracking zone, contacting the liquid bottoms product, the at least a portion of the hydrogen rich gaseous stream and the make-up hydrogen at hydrocracking conditions, which comprise a temperature range from about 400° F. to about 950° F., a pressure range from about 500 psig to about 5000 psig, a flow rate range of about 0.1 hr to about 15 $hr^{-1}$ LHSV, and an overall hydrogen consumption range of from about 500 to about 2500 scf per barrel of liquid hydrocarbon feed, with a hydrocracking catalyst and recovering therefrom a hydrocracking zone effluent;

e) passing the hydrocracking zone effluent to a vapor recovery zone, the vapor recovery zone being in fluid communication with the hydrotreating zone and the hydrocracking zone, and recovering from the vapor recovery zone a vapor stream and a hydrocracked liquid stream;

f) passing the hydrocracked liquid stream to the separation zone; and, g) passing the vapor stream without substantial cooling to the hydrotreating zone for combining with the hydrogen feed stream.

11. The method according to claim 10 wherein the hydrocracked liquid stream and the hydrotreated liquid stream are combined, and the combination passed to the separation zone.

12. The method according to claim 10 wherein the vapor stream is recovered from the vapor recovery zone at a temperature of at least about 500° F. (177° C.).

13. The method according to claim 10 wherein the vapor recovery zone is maintained at substantially the same pressure and at substantially the same temperature as the hydrocracking zone.

14. The method according to claim 10 wherein the hydrogen rich gaseous stream is recovered from the purification zone at a temperature between about 100° F. and about 300° F. (38° C.–149° C.).

15. The method according to claim 10 wherein at least a portion of the hydrogen rich gaseous stream is introduced to the hydrotreating zone as a quench stream.

16. The method according to claim 10 wherein at least a portion of the hydrogen rich gaseous stream is introduced to hydrocracking zone as a quench stream.

* * * * *